United States Patent [19]

Uchida

[11] Patent Number: 5,063,116

[45] Date of Patent: Nov. 5, 1991

[54] WIRE FOR DOT PRINTER

[75] Inventor: Norimasa Uchida, Yonago, Japan

[73] Assignee: Hitachi Metals, Ltd., Tokyo, Japan

[21] Appl. No.: 619,431

[22] Filed: Nov. 29, 1990

[30] Foreign Application Priority Data

Mar. 16, 1990 [JP] Japan ..... 2-066131

[51] Int. Cl.[5] ..... C22C 38/22; C22C 38/24; C22C 38/36; B41J 2/25

[52] U.S. Cl. ..... 428/606; 420/12; 400/124

[58] Field of Search ..... 428/606; 400/124; 420/12, 15, 17, 37, 67, 100, 102, 107, 114; 75/241, 242, 246

[56] References Cited

U.S. PATENT DOCUMENTS

| | | | |
|---|---|---|---|
| 3,850,621 | 11/1974 | Haberling et al. | 420/12 |
| 4,626,116 | 12/1986 | Sagara et al. | 420/37 |
| 4,652,157 | 3/1987 | Uzawa et al. | 400/124 |

FOREIGN PATENT DOCUMENTS

| | | | |
|---|---|---|---|
| 52-96119 | 8/1977 | Japan . | |
| 52-110121 | 9/1977 | Japan . | |
| 53-40316 | 4/1978 | Japan | 400/124 WD |
| 54-54713 | 5/1979 | Japan . | |
| 57-188386 | 11/1982 | Japan | 400/124 WD |
| 58-112760 | 7/1983 | Japan | 400/124 WD |
| 58-175673 | 10/1983 | Japan | 400/124 WD |
| 60-197848 | 10/1985 | Japan | 400/124 WD |
| 60-204872 | 10/1985 | Japan | 400/124 WD |
| 1-83643 | 3/1989 | Japan . | |
| 1-180356 | 7/1989 | Japan | 400/124 WD |
| 2-332156 | 7/1990 | Japan . | |

*Primary Examiner*—John J. Zimmerman

*Attorney, Agent, or Firm*—Finnegan, Henderson, Farabow, Garrett & Dunner

[57] ABSTRACT

A powder metallurgy wire for a dot printer is disclosed which consists, by weight, of 1.5 to 2.8% C, 7.5 to 12.0% Cr, at least one kind selected from the group consisting of not more than 18.0% W and not more than 11.0% Mo which W and Mo meet the relationship of $12 \leqq W+2Mo \leqq 22$, 3 to 10% V, 1.0 to 10% Co, not more than 1.0% Si, not more than 1.0% Mn, the balance Fe and incidental impurities, the value of the difference of (C-Ceq) being in the range of −0.5 to −0.15 where $Ceq=0.06\times\%Cr+0.033\times\%W+0.063\times\%Mo+0.2\times\%V$. According to the composition, corrosion resistance and wear resistance are considerably improved, with light weight and high toughness.

7 Claims, No Drawings

WIRE FOR DOT PRINTER

BACKGROUND OF THE INVENTION

The present invention relates to a printing wire for a dot matrix type printer head.

The following three points have been demanded for material characteristics as a printing wire used in a dot matrix type printer head:

(1) The wire has high wear resistance. Since a tip end of the wire hits an ink ribbon over $10^8$ times, the tip end is apt to be worn out, resulting in unclear printing. In addition, since the wire is always in sliding relation to a guide, a side wall of the wire is apt to be worn out, which leads to a poor printing precision.

(2) The wire is light in weight. The printing wire must move at a high speed. Thus, in order to increase the printing speed, it is necessary for the wire to be light in weight.

(3) The wire has high toughness. Since the wire is disposed to be cured by an intermediate guide, the wire is apt to be broken during the assembling of the wire or the printing operation thereof. Accordingly, high toughness is needed for the wire.

The printing wire of this type is made, in general, of a fine wire of a cemented carbide, a tungsten fine wire, a fine wire of a high speed tool steel or the like. In these materials, the cemented carbide is superior in wear resistance but its specific weight is large so that the wire is heavy in weight. Therefore, this is not suitable for high speed printing. In addition, since its toughness is low, the wire of the cemented carbide is apt to be damaged or broken down during the assembling work, with the result that the reliability of the wire is not satisfactory.

The tungsten wire has such problems that its specific weight is large, fibrous structure is developed due to high degree plastic working so that the wire is apt to be cracked longitudinally into two halves, and that the abrasion resistance is not satisfactory.

A high speed tool steel classified in JIS SKH51 (corresponding to AISI M2) has a small specific weight which is about half the specific weight of the cemented carbide or tungsten, and has also a high toughness. In addition, in the high speed tool steel, it is possible to obtain a hardness of Hv700 to Hv900. In addition, since a suitable amount of non-solid-solutioned carbide is dispersed in the matrix, its abrasion resistance is high. Accordingly, the material has been frequently used as a wire for a dot printer wire.

The high speed tool steels are classified into two kinds in accordance with a production process, i.e., a first one produced through a conventional melting method and a second one produced through a powder metallurgy method. Since the amount of carbon and the amount of carbide forming elements can be increased in the high speed tool steel produced according to the powder metallurgy method, the wear resistance is increased. Accordingly, the high speed tool steel produced through the powder metallurgy method has been more frequently used. However, this material has problems regarding workability for making fine wires. As a result, the powder metallurgy high speed tool steel available on the market is restricted substantially to two kinds of materials, i.e., 1.3C—4Cr—6W—5Mo—3-V—8Co and 2.0C—4Cr—8W—4Mo—6V—6Co. However, in order to meet the higher speed requirement and the longer service life of the printer, these powder metallurgy high speed tool steels are still not satisfactory.

Regarding prior art attempts to enhance the wear resistance of the printing wire, for example, Japanese Patent Unexamined Publication No. 52-110121 discloses a method in which a chip of cemented carbide is bonded to a tip end of the wire, Japanese Patent Unexamined Publication No. 54-54713 discloses a method in which impact quenching is effected at the tip end of the wire by using laser irradiation or the like, and Japanese Patent Unexamined Publication No. 52-96119 discloses a method in which a surface of the wire is coated with hard composite material through chemical vapour deposition process.

In the conventional methods for enhancing the abrasion resistance of the printing wire, each of the method in which the chip of cemented carbide is bonded to the tip end of the wire, the method in which the impact quenching is effected at the end portion by the laser irradiation or the like, and the method in which the wire surface is coated with hard composite material through the chemical vapour deposition process, has such disadvantages that each of the methods is not suitable for mass-production, resulting in high cost. At present, these methods have not been put into industrial use.

The present inventors observed and searched the abrasion state of the wire tip end in order to enhance the service life of the printing wire. As a result, it has been found that the wear due to the corrosion occurs at the wire tip end simultaneously together with the abrasive wear due to graphite fine particles which are pigments or dyes contained in the ink. It is considered that this is caused by the corrosion effect occurring at the wire material due to specific fatty acid ranging from several % to several tens % which fatty acid is contained in the ink. It is therefore found that it is necessary to use a wire material which is superior in corrosion resistance and well as abrasive wear resistance, in order to enhance the service life of the printing wire.

Based upon the above-described findings, the present inventors filed Japanese Patent Unexamined Publication. No. 1-83643 and Japanese Patent Application No. 63-332156 proposing the improvement of the corrosion resistance of the dot wire material by increasing he content of Cr. However, the present inventors have studied whether or not these material could meet the various requirements for the dot wire. As a result, it has been found that the material set forth in Japanese Patent Unexamined Publication No. 1-83643 shows a satisfactory corrosion resistance but is somewhat insufficient in hardness after the quenching-tempering thereof. It is therefore necessary to increase the hardness in order to further suppress the printing wear. It is also found that the material disclosed in Japanese Patent Application No. 63-332156 suffers a difficulty in working when a hot rolled wire material is wire-drawn to a wire diameter of 0.2 to 0.3 mm which is needed for the dot wire. Also, in the latter case, it has been found that the bending and the deterioration in toughness are apt to occur due to a large amount of residual austenite upon quenching.

SUMMARY OF THE INVENTION

In a high Cr-content high speed tool steel having a small specific weight high wear resistance and high corrosion resistance, an object of the invention is to obtain a high performance and economical printing wire in which the linear elongation property and toughness are further enhanced to be capable of meeting the higher speed and longer service life requirements.

The present inventors have found that there is a suitable relationship between the content of C and the content of a carbide forming elements (Cr, W, Mo and V) and a balance between these contents so as to solve the problems inherent in Japanese Patent Applications Nos. 1-83643 and 63-332156 to thereby attain the object of the invention and to complete the present invention.

According to the present invention, there is provided a wire for a dot printer consisting, by weight, of 1.5 to 2.8% C, 7.5 to 12.0% Cr, at least one kind selected from the group consisting of not more than 18.0% W and not more than 11.0% Mo both which meet the relationship of $12 \leqq W+2Mo \leqq 22$, 3 to 10% V, 1.0 to 10% Co, not more than 1.0% Si, not more than 1.0% Mn, the balance Fe and incidental impurities, wherein the difference between the content of C and Ceq is in the range of $-0.5$ to $-0.15$ where $Ceq=0.06\times\%\ Cr+0.033\times\%\ W+0.063\times\%\ Mo+0.2\times\%\ V$.

The reason of the composition limitation according to the invention will be explained below.

C reacts with Cr, W, Mo and V to form hard carbides to enhance an abrasive type wear resistance. A part of the carbides is in a solid-solution state and is again precipitated in a martensitic matrix during a quenching-tempering heat treatment to thereby enhance a hardness of the matrix. If the content of C is less than 1.5%, this effect can not sufficiently be obtained, while, if the content exceeds 2.8%, both the toughness and the wire drawability etc. become remarkably degraded. Thus, the content of C is selected in a range of 1.5 to 2.8%, more preferably, 1.8 to 2.0%.

As described above, C is one of the important elements for this invention. However, the amount of C must be well balanced with the amounts of Cr, W, Mo and V added simultaneously. If the amount of C deviates from the range shown above, the object of the invention can not be attained. More specifically, the amount of C must be adjusted so that the difference between the content of C and Ceq is in the range of $-0.5$ to $-0.15$ where $Ceq=0.06\times\%\ Cr+0.033\times\%\ W+0.063\times\%\ Mo+0.2\times\%\ V$.

If the amount of C exceeds this range, there will occur the following disadvantages.

Namely, i) the material according to the invention relates to a high Cr high speed tool steel containing 7.5 to 12.0% Cr. However, if the amount of C is high, there occurs a large amount of carbide readily solid-solutioned in the form of $Cr_{23}C_8$ with the result that the solid-solution amount of C in the matrix increases due to the quenching heat treatment to thereby increase the amount of the residual austenite drastically. When the fine wire having a diameter of 0.2 to 0.3 mm to which the invention pertains is subjected to the quenching-tempering heat treatment, the material in which such large amount of the residual austenite is formed causes an extremely large heat treatment deformation (bending) and almost all the material is faulty. In addition, such material has a low bending strength and can not be put into practical use.

ii) Since the hardness of the material is not sufficiently decreased to make the ductility be inferior even when it is subjected to annealing, the wire drawability that is important for the dot wire is degraded. As a result, it is impossible to produce the fine wires of 0.2 to 0.3 mm in diameter on an industrial scale.

iii) More carbon reacts with Cr to increase carbide, and on the contrary, the amount of the solid solution of Cr into the matrix is reduced, resulting in substantial loss of the corrosion resistance. Thus, the object of the invention can not be attained.

On the other hand, in the case where the amount of C is in such a condition as $C-Ceq<-0.5$, even if the material is subjected to the quenching-tempering heat treatment, it is impossible to obtain a sufficiently high hardness and the abrasive wear resistance of the wire is deteriorated.

Cr is one of the important elements of the present invention. Cr is effective to minimize the corrosion wear occurring due to the fatty acid contained in the ink ribbon. The higher the content of Cr, the less corrosion will occur. However, if the content of Cr is simply increased, it will be impossible to enhance the whole corrosion resistance the improvement of which is one of the objects of the invention. It is important to well balance the amount of Cr with the amount of C added simultaneously, that is, $(C-Ceq)$.

By making the C balance according to the invention be in the limited range, if the content of Cr is equal to or more than 7.5%, the effect is remarkably observed in comparison with a conventional high speed tool steel wire.

The present invention is characterized in that Cr of the high speed tool steel is combined with C to form hard carbides so that superior wear resistance is obtained because of the effect of minimizing abrasive wear of wire, and that the amount of Cr in the matrix is increased to enhance the corrosion resistance, whereby there is obtained wire material having both superior abrasive wear resistance and superior corrosion resistance. However, if the amount of Cr exceeds 12.0% in the alloy composition according to the invention, the amount of carbide will be excessively increased, resulting in difficulty in wire drawing on a industrial scale. Accordingly, the content of Cr is determined in a range of 7.5 to 12.0% by weight. The preferable range of the content of Cr is between 9.0 and 10.5%.

W and Mo are combined with C in the same manner as Cr, to form a hard carbide, and are therefore effective against abrasive wear. At the same time, a secondary hardening occurs during tempering. As a result, the matrix is hardened to effect the improvement of the wear resistance. In addition, since W and Mo have the effect of suppressing the reduction in hardness when the material is heated at a high temperature, it is possible to minimize the reduction in hardness of a bonded portion when the wire is brazed to an armature, resulting in the remarkable increase of the service life against fatigue. In order to obtain the above-described advantage, the material must contain at least one of not more than 18.0% W and not more than 11.0% Mo both of which W and Mo meet the relationship of $W+2Mo \geqq 12\%$, more preferably, $W+2Mo \geqq 14\%$. However, in a case where the amount of W and/or Mo is excessive, the bending strength is reduced and the wire drawability is deteriorated, disadvantageously. Accordingly, the relationship of W and Mo is determined as $12 \leqq W+2Mo \leqq 22$.

V forms a hard vanadium carbide by the reaction with C. In particular, a hardness of V carbide (about Hv3000) is twice larger than that (about Hv1500) of Cr carbide, so that V brings about remarkable resistance against the abrasive water. Accordingly, it is desired to increase the amount of V as much as possible. However, the V carbide has a poor wettability with the matrix and causes deterioration of the toughness. Therefore, the range of V is 3–10%. More preferably, the range of V is 4–6%.

Co has an effect of enhancing the corrosion resistance and enhances the heat resistance of the wire to thereby improve the fatigue strength of a brazed portion. Thus, Co is one of the effective elements. If the content of Co is less than 1.0%, such an effect is insufficient. On the other hand, if it exceeds 10%, the wire drawability and toughness are degraded. The range of Co is 1.0 to 10%. More preferably, the range of Co is 2 to 5%.

Si is added as a deoxidizing agent and has an effect of increasing the hardness because of the solid-solutioning of Si in the matrix. However, if the amount is excessive, the toughness is deteriorated. Therefore, the range of Si is not more than 1% by weight.

Mn is added also as a deoxidizing agent. However, if the content of Mn is excessive, the hardness after the quenching is lowered. Accordingly, the amount of Mn is not more than 1.0% by weight.

If N is contained in the rang of 0.04 to 0.15 wt %, a hard and stable carbo-nitride in the form of VCN is formed to enhance the wear resistance. In particular, in the case of the high Cr high speed tool steel according to the invention, a large amount of N is contained in the molten high speed tool steel.

The objects of the invention may sufficiently be achieved by the addition of the alloy elements shown above. However, if raw materials are selected or are refined so that Ni is not more than 0.4%, O is not more than 0.007% and Al is not more than 0.006%, it becomes possible to enhance the wire drawability of the wire material.

The alloy according to the invention contains a large amount of carbides such as W, Mo and V carbides. Such carbides are apt to be in the form of coarse rods or in angular shape when a conventional melting method is adopted. Accordingly, in the case where the carbides are used as one of essential factors of the wire material, it is necessary that a dimension of ingot is made to be small enough to increase the cooling speed upon solidification, so that the carbides are made fine in size. In particular, in a case where the above described alloy is produced through a powder metallurgy method, by controlling the hot working condition and the grain size of powder so as to obtain fine spherical carbide structure having an average grain size of not more than 1.5 micrometer in grain size, a satisfactory wire drawability is obtained upon the wire drawing of the wire material which wire drawing is effected to obtain a diameter of 0.2 to 0.3 mm. Thus, it is possible to obtain the most desirable wire material for the printer so as to attain the objects of the invention.

Preferred Embodiments of the Invention

EXAMPLE 1

The wire materials having chemical compositions shown in Table 1 were produced through a powder metallurgy method, and were subjected to quenching-tempering heat treatments under the conditions shown in Table 2. Incidentally, the average grain size of the carbide existing in the material of the invention was in the range of 0.98 to 1.24 micrometers.

The hardness of the material in an as-quenched state and the hardness after the tempering of the material are shown in Table 2. The hardness of each of the quenched steels according to the invention was in a proper range not less than $H_{RC}62$, however, the steels of Nos. 9 and 11 for comparison were extremely low in hardness in the quenched state due to such fact that, since the material has a high Cr amount and a high value of C−Ceq, a large amount of residual austenite is formed by the quenching thereof. Such material in which a large amount of residual austenite is formed causes a large deformation during the thermal treatment and is not suitable for a material used in the dot wire. When in a case where a material is used for producing the dot wire, if the hardness obtained after the tempering at a temperature of 560° C. is not less than $H_{RC}67$, the wear resistance and the fatigue strength for the printing wire become insufficient. Each of the examples according to the invention met the requirements, however, since the amount of W+2Mo in the comparison material Nos. 10 and 11 was small in comparison with the present invention, and since the difference of C−Ceq of the comparison material No. 12 was low, the satisfactory characteristics were not obtained.

TABLE 1

| No. | CHEMICAL COMPOSITION (wt %) | | | | | | | | | | | | | | NOTE |
|---|---|---|---|---|---|---|---|---|---|---|---|---|---|---|---|
| | C | Si | Mn | Ni | Cr | W | Mo | V | Co | O | Al | N | W + 2 Mo | C − Ceq | |
| 1 | 2.02 | 0.3 | 0.4 | 0.6 | 7.9 | 3.8 | 4.8 | 6.8 | 7.6 | 0.008 | 0.010 | 0.032 | 13.4 | −0.24 | STEEL OF THE INVENTION |
| 2 | 1.86 | 0.3 | 0.3 | 0.2 | 8.7 | 4.0 | 5.9 | 5.3 | 4.2 | 0.005 | 0.004 | 0.038 | 15.8 | −0.23 | STEEL OF THE INVENTION |
| 3 | 1.69 | 0.5 | 0.3 | 0.1 | 8.2 | 2.1 | 8.6 | 4.8 | 5.1 | 0.004 | 0.005 | 0.049 | 19.3 | −0.37 | STEEL OF THE INVENTION |
| 4 | 1.92 | 0.4 | 0.3 | 0.1 | 9.8 | 4.2 | 6.1 | 5.3 | 3.2 | 0.005 | 0.005 | 0.035 | 16.4 | −0.25 | STEEL OF THE INVENTION |
| 5 | 1.89 | 0.4 | 0.4 | 0.1 | 9.9 | 4.1 | 6.0 | 4.9 | 2.9 | 0.006 | 0.004 | 0.058 | 16.1 | −0.20 | STEEL OF THE INVENTION |
| 6 | 2.18 | 0.3 | 0.3 | 0.2 | 10.2 | 8.4 | 4.4 | 6.8 | 4.9 | 0.006 | 0.005 | 0.044 | 17.2 | −0.35 | STEEL OF THE INVENTION |
| 7 | 2.19 | 0.3 | 0.3 | 0.1 | 11.3 | — | 6.3 | 6.7 | 8.2 | 0.008 | 0.009 | 0.029 | 12.6 | −0.22 | STEEL OF THE INVENTION |
| 8 | 1.82 | 0.6 | 0.3 | 0.1 | 9.8 | 1.9 | 7.0 | 4.7 | 4.8 | 0.005 | 0.005 | 0.052 | 15.6 | −0.21 | STEEL OF THE INVENTION |
| 9 | 2.02 | 0.3 | 0.3 | 0.5 | 9.8 | 4.0 | 5.1 | 4.9 | 3.2 | 0.012 | 0.012 | 0.034 | 14.2 | 0 | COMPARISON STEEL |
| 10 | 2.21 | 0.3 | 0.3 | 0.1 | 9.7 | 0.1 | 3.9 | 6.5 | 5.2 | 0.010 | 0.012 | 0.032 | 7.9 | +0.08 | COMPARISON STEEL |
| 11 | 2.29 | 0.3 | 0.4 | 0.4 | 11.6 | 0.6 | 1.5 | 5.5 | — | 0.012 | 0.013 | 0.035 | 3.6 | +0.38 | COMPARISON STEEL |
| 12 | 1.45 | 0.4 | 0.3 | 0.8 | 10.3 | 4.0 | 5.3 | 4.8 | 2.8 | 0.011 | 0.010 | 0.035 | 14.6 | −0.59 | COMPARISON STEEL |
| 13 | 1.32 | 0.3 | 0.3 | 0.5 | 3.9 | 5.8 | 4.8 | 3.4 | 7.9 | 0.009 | 0.011 | 0.038 | 15.8 | −0.09 | CONVENTIONAL STEEL |

TABLE 2

| No. | HEAT TREATMENT | QUENCHED HARDNESS (HRC) | TEMPERED HARDNESS (HRC) | WEAR RESISTANCE (mg) | CORROSION RESISTANCE ($g/cm^2 \cdot h$) | BENDING STRENGTH ($kgf/mm^2$) |
|---|---|---|---|---|---|---|
| 1 | 1160° C. − 560° C. × (1 + 1 + 1)h | 62.3 | 67.2 | 28 | $7.0 \times 10^{-2}$ | 448 |
| 2 | 1160° C. − 560° C. × (1 + 1 + 1)h | 64.6 | 68.1 | 26 | $6.8 \times 10^{-2}$ | 408 |
| 3 | 1180° C. − 560° C. × (1 + 1 + 1)h | 66.2 | 68.5 | 23 | $6.7 \times 10^{-2}$ | 400 |

TABLE 2-continued

| No. | HEAT TREATMENT | QUENCHED HARDNESS (HRC) | TEMPERED HARDNESS (HRC) | WEAR RESISTANCE (mg) | CORROSION RESISTANCE ($g/cm^2 \cdot h$) | BENDING STRENGTH ($kgf/mm^2$) |
|---|---|---|---|---|---|---|
| 4 | 1160° C. – 560° C. × (1 + 1 + 1)h | 64.3 | 68.2 | 26 | $6.4 \times 10^{-2}$ | 427 |
| 5 | 1160° C. – 560° C. × (1 + 1 + 1)h | 63.5 | 68.3 | 22 | $6.5 \times 10^{-2}$ | 418 |
| 6 | 1180° C. – 560° C. × (1 + 1 + 1)h | 65.4 | 68.2 | 20 | $6.2 \times 10^{-2}$ | 423 |
| 7 | 1160° C. – 560° C. × (1 + 1 + 1)h | 62.5 | 67.0 | 28 | $6.0 \times 10^{-2}$ | 453 |
| 8 | 1160° C. – 560° C. × (1 + 1 + 1)h | 64.8 | 68.0 | 23 | $6.4 \times 10^{-2}$ | 412 |
| 9 | 1160° C. – 560° C. × (1 + 1 + 1)h | 56.4 | 67.1 | 31 | $7.5 \times 10^{-2}$ | 340 |
| 10 | 1160° C. – 560° C. × (1 + 1 + 1)h | 58.0 | 61.3 | 40 | $7.9 \times 10^{-2}$ | 380 |
| 11 | 1160° C. – 540° C. × (1 + 1 + 1)h | 52.5 | 63.1 | 36 | $7.9 \times 10^{-2}$ | 320 |
| 12 | 1160° C. – 560° C. × (1 + 1 + 1)h | 64.3 | 64.6 | 37 | $6.4 \times 10^{-2}$ | 440 |
| 13 | 1200° C. – 560° C. × (1 + 1 + 1)h | 67.2 | 67.4 | 44 | $13.4 \times 10^{-2}$ | 463 |

With respect to the material Nos. 1 to 13 shown in Table 1, the abrasive wear resistance was evaluated by a method comprising the steps of preparing a test piece having a diameter of 6 mm, and moving the test piece 1,000 mm while keeping pressure contact with SiC grinding paper of No. 500 under such conditions that the circumferential speed was 15 m/min, that the feed amount was 60 mm/min and that the load was 10 kgf. The amount (mg) of of the wear occurring after the test is shown in Table 2. It is apparent that the wear amount of the materials used in the invention is small in comparison with the conventional material and the comparison materials.

Then, the corrosion resistance was evaluated by using the same test pieces as shown in Table 1. A 10% HNO aqueous solution was used for an acceleration test instead of the fatty acid with respect to corroding liquid, and the amounts of corrosion decrease per unit area and per unit period of time were measured. With respect to the corroding amount of the material according to the invention, it satisfactory being about half that of the conventional material (No. 13). The comparison materials No. 9 to No. 11 were somewhat inferior to those of the invention.

Next, a bending strength test was conducted to evaluated the toughness. The size of each of the test pieces was 5 mm (in diameter)×70 mm in length, the distance between the support points being 50 mm, and the central point loading mode was used. Table 2 shows the result in terms of the bending strengths. The materials according to the invention have substantially the same value as the convention material No. 13 and has sufficient toughness required in the dot wire material. The comparison materials No. 9 to 11 were inferior regarding the deflective strength with the result that there is concern that the material Nos. 9 to 11 may be broken down during the use thereof.

As described above, it has been found that each of the hardness, the abrasion resistance, the corrosion resistance and the bending strength requirements is met by the materials according to the invention.

EXAMPLE 2

The test piece Nos. 1, 2, 4 and 5 of the invention, the comparison test piece Nos. 9, 10 and 12, and the conventional test piece No. 13 were wire-drawn to a diameter of 0.3 mm. In these test pieces, the comparison material Nos. 9 and 10 were broken several times during the wire drawing and were insufficient in wire-drawability. The material No. 1 was once broken, and the material Nos. 12 and 13 were twice broken. Other materials were not broken and are deemed to be producible on an industrial scale.

The wire materials of 0.3 mm in diameter were subjected to quenching and tempering, and thereafter were installed in an actual printer head. Then, a printing test was conducted. In this case, the comparison material Nos. 9 and 10 experienced a phenomenon of large bending occurring due to a heat treatment deformation. After one hundred million times of dot printing, the amount of wear of the wire end was measured. The wear amount of the materials of the invention was very small (No. 1 was 42 micrometers, No. 2 was 37 micrometers, No. 4 was 35 micrometers, and No. 5 was 34 micrometers). However, the wear amounts of the comparison materials Nos. 9, 10 and 11 were 47 micrometers, 52 micrometers, and 52 micrometers, respectively. The wear amount of the conventional material No. 13 was 86 micrometers. These comparison and prior art materials experienced large amounts of wear. It was found that the material according to the invention was superior in wear resistance.

As described above, according to the present invention, it is possible to remarkably enhance the corrosion resistance and the wear resistance of a wire used for dot printer while these resistances are insufficient in the prior art. In addition, the material of the invention is a steel base material and hence has a feature of light weight and high toughness. Accordingly, the wire of the invention can meet the high speed and long service life requirements for the printer.

Furthermore, the material according to the present invention is superior in both wire drawability and heat treatment characteristics and may be produced stably in an industrial scale.

What is claimed is:

1. A wire for a dot printer, consisting, by weight, of 1.5 to 2.8% C, 7.5 to 12.0% Cr, at least one kind selected from the group consisting of not more than 18.0% W and not more than 11.0% Mo which W and Mo meet the relationship of $12 \leqq W+2Mo \leqq 22$, 3 to 10% V, 1.0 to 10% Co, not more than 1.0% Si, not more than 1.0% Mn, the balance Fe and incidental impurities, the difference between the content of C and the value of carbon equivalent which difference is defined by C−Ceq is in the range of −0.5 to −0.15 where $Ceq=0.06\times\%\ Cr+0.033\times\%\ W+0.063\times\%\ Mo+0.2\times\%\ V$.

2. A wire for a dot printer, consisting, by weight, of 1.8 to 2.0% C, 9.0 to 10.5% Cr, at least one kind selected from the group consisting of 2 to 12% W and 2 to 8% Mo which W and Mo meet the relationship of $14 \leqq W+2Mo \leqq 18$, 4 to 6% V, 2 to 5% Co, 0.1 to 0.5% Si, 0.1 to 0.5% Mn, the balance Fe and incidental impurities, the value of (C−Ceq) being in the range of −0.35 to −0.15 where $Ceq=0.06\times\%\ Cr+0.033\times\%\ W+0.063\times\%\ Mo+0.2\times\%\ V$.

3. The wire according to claim 1 or 2, wherein in a metal structure forming the wire, an average grain size of carbide is not more than 1.5 μm.

4. A wire for a dot printer, consisting, by weight, of 1.5 to 2.8% C, 7.5 to 12.0% Cr, 0.04 to 0.15% N, at least one kind selected from the group consisting of not more than 18.0% W and not more than 11.0% Mo which W and Mo meet the relationship of $12 \leqq W+2Mo \leqq 22$, 3 to 10% V, 1.0 to 10% Co, not more than 1.0% Si, not more than 1.0% Mn, the balance Fe and incidental impurities, the difference between the content of C and the value of carbon equivalent which difference is defined by C−Ceq is in the range of −0.5 to −0.15 where $Ceq=0.06\times\%\ Cr+0.033\times\%\ W+0.063\times\%\ Mo+0.2\times\%\ V$.

5. A wire for a dot printer, consisting, by weight, of 1.8 to 2.0% C, 9.0 to 10.5% Cr, 0.04 to 0.15% N, at least one kind selected from the group consisting of 2 to 12% W and 2 to 8% Mo which W and Mo meet the relationship of $14 \leqq W+2Mo \leqq 18$, 4 to 6% V, 2 to 5% Co, 0.1 to 0.5% Si, 0.1 to 0.5% Mn, the balance Fe and incidental impurities, the value of (C−Ceq) being in the range of −0.35 to −0.15 where $Ceq=0.06\times\%\ Cr+0.033\times\%\ W+0.063\times\%\ Mo+0.2\times\%\ V$.

6. The wire according to claim 5, wherein in a metal structure forming the wire, an average grain size of carbide is not more than 1.5 μm.

7. The wire according to claim 1, 2, 4 or 5 wherein as incidental impurities, Ni is not more than 0.4%, O is not more than 0.007%, and Al is not more than 0.006% by weight.

* * * * *

UNITED STATES PATENT AND TRADEMARK OFFICE

CERTIFICATE OF CORRECTION

PATENT NO. : 5,063,116

DATED : November 5, 1991

INVENTOR(S) : NORIMASA UCHIDA

It is certified that error appears in the above-identified patent and that said Letters Patent is hereby corrected as shown below:

Claim 1, col. 8, line 58, change line to read --Ceq=0.06 x %Cr + 0.033 x %W + 0.063 X %--.

Claim 2, col. 8, line 67, change line to read --to -0.15 where Ceq = 0.06 x %Cr + 0.033 x %--.

Claim 4, col. 9, line 16 change line to read --Ceq=0.033x%W + 0.063x% --.

Claim 6, col. 10, line 10, after "claim" insert --4 or--.

Signed and Sealed this

Twentieth Day of April, 1993

*Attest:*

*Attesting Officer*

MICHAEL K. KIRK

*Acting Commissioner of Patents and Trademarks*